US005460088A

United States Patent [19]

Heiler et al.

[11] Patent Number: 5,460,088

[45] Date of Patent: Oct. 24, 1995

[54] PRINTING PRESS

[75] Inventors: Peter Heiler, Forst; Jürgen Rautert, Heidelberg, both of Germany

[73] Assignee: Heidelberger Druckmaschinen Aktiengesellschaft, Heidelberg, Germany

[21] Appl. No.: 228,693

[22] Filed: Apr. 18, 1994

[30] Foreign Application Priority Data

Apr. 16, 1993 [DE] Germany ..... 43 12 523.9

[51] Int. Cl.[6] ..... B41F 7/06; B41F 7/40; B41F 31/34

[52] U.S. Cl. ..... 101/142; 101/148; 101/484; 101/352

[58] Field of Search ..... 101/136, 137, 101/139, 140, 142, 143, 144, 145, 177, 247, 351, 352, 148, 484, 483, 485, 486, 147

[56] References Cited

U.S. PATENT DOCUMENTS 3,259,060 7/1966 Martin ..... 101/144

5,170,706 12/1992 Rudi et al. ..... 101/148

FOREIGN PATENT DOCUMENTS 2649003 5/1978 Germany .

1554796 10/1979 United Kingdom .

*Primary Examiner*—J. Reed Fisher

*Attorney, Agent, or Firm*—Nils H. Ljungman & Associates

[57] ABSTRACT

A printing press has at least one printing stand with a plate cylinder, an inking unit for providing ink to the plate cylinder, a blanket cylinder, an impression cylinder, a sheet feed device for feeding printing stock into the print stand, and a dampening unit for feeding dampening medium to the printing plate of the plate cylinder. The dampening unit has at least one form roller engageable with the plate cylinder, a dipping roller dipping into dampening medium contained in a dampening-medium tank, at least one intermediate roller provided between the form roller and dipping roller, adjusting means through which the form roller is engageable with the plate cylinder and the intermediate roller with the form roller and the dipping roller, and a device for preventing any permanent deformation on the elastic outer cylindrical surface when the printing press is at a standstill.

20 Claims, 6 Drawing Sheets

PRINTING PRESS

BACKGROUND OF THE INVENTION

1. Field of the Invention

This invention generally relates to an offset rotary printing press having at least one printing stand with a plate cylinder, an inking unit for providing ink to the plate cylinder, a blanket cylinder, an impression cylinder, a sheet feed device for feeding printing stock into the print stand, and a dampening unit for feeding dampening medium to the printing plate of the plate cylinder. More specifically, the present invention relates to a dampening unit for an offset printing machine, which dampening unit can preferably have at least one forme roller that is engageable with the plate cylinder, a dipping roller dipping into dampening medium contained within a dampening-medium tank, at least one intermediate roller provided between the forme roller and the dipping roller, and adjusting means, by means of which the forme roller can be engageable with the plate cylinder and by means of which the intermediate roller can be engageable with the forme roller. At the dipping roller, the forme roller can preferably be pivot-mounted, and an additional connecting device can be provided between the forme roller and the intermediate roller to interconnect the forme roller and the intermediate roller.

2. Background Information

German Patent DE 31 46 223 C2 discloses one type of dampening unit for use in high-performance machines in which the dampening rollers involved may assume different positions. In this case, rollers having respective elastic outer cylindrical surfaces, called "blanket rollers", always cooperate with distributor rollers or intermediate rollers featuring respective rigid outer cylindrical surfaces. As such, if a printing machine is out of operation for several days, e.g. over the weekend, and contact pressure is left on between the blanket roller and, for example, a distributor roller, the contact pressure existing between the rollers may lead to a permanent deformation on the elastic outer cylindrical surface of the blanket roller. Once such a deformation has occurred, the deformation can typically only be eliminated after a rather long period of machine operation. In the area of the deformation of the outer cylindrical surface, the transfer of the thin dampening-medium film is affected, and the supply of dampening-medium to the printing plate may then fluctuate.

OBJECT OF THE INVENTION

On the basis of the above discussion, it is the object of the invention to provide a printing press and corresponding dampening unit which precludes permanent deformation of the elastic outer cylindrical surface of the dipping roller, in particular, in the event that a rather long machine shutdown occurs.

SUMMARY OF THE INVENTION

According to the present invention this object can preferably be achieved by means of a dampening unit in which, at least while the printing machine is at a standstill, the intermediate roller can essentially be configured to be automatically disengageable from the dipping roller. Such a disengagement can preferably be provided by means of a force-storing device, such as a biasing device, or spring which is provided to bias the intermediate roller and the dipping roller away from one another. This configuration essentially makes it possible to provide an automatic separation between the intermediate roller and the dipping roller. Thus, any permanent deformation on the elastic outer cylindrical surface of the dipping roller can essentially be prevented to thereby preferably provide an optimum supply of dampening-medium to the printing plate.

An advantageous embodiment of the present invention is characterized in that, on both sides of the dipping roller, there can preferably be provided levers which can be mounted so as to pivot about the center of the dipping roller, and that adjusting levers, in which the intermediate roller can be mounted, can be pivot-mounted on the levers. The levers and the adjusting levers can also preferably be supported with respect to each other via a spring element. In addition, adjusting cams can preferably be provided on both sides of the dipping roller, and can preferably be mounted so as to pivot about the center of the dipping roller. There can also be provided adjusting means configured for acting on the adjusting cams, which adjusting means, when being in a shift position, turn the lever anticlockwise in order to engage the forme roller with the plate cylinder so that, via an adjusting screw, the adjusting lever is turned as well and all rollers are in engagement with each other. In a second shift position in which the forme roller is disengaged from the plate cylinder, the adjusting cam turns the adjusting lever and, via an adjusting screw, the lever clockwise, so that the forme roller is disengaged from the plate cylinder and the intermediate roller is disengaged from the forme roller. It is also preferable that the adjusting means be a force-free adjusting means, that is, a device which applies no force when power is disconnected therefrom. As such, the spring element can thereby preferably pivot the adjusting lever away from the lever, so that the intermediate roller can be disengaged from the dipping roller. With this solution, it can generally be sufficient to provide, on both sides of the machine, one single adjusting means for respectively engaging and disengaging all rollers as described hereinabove and to also disengage the dipping roller from the intermediate roller when the printing machine is at a standstill.

In a further embodiment of the invention the lever is in contact with a stop, which is engaged in a clockwise movement, with the rollers being in disengaged positions.

In summary, one aspect of the invention resides broadly in a printing press for printing images on sheets of printing stock, the printing press having periods of time during which the printing press is operating, and periods of time during which the printing press is at a standstill. The printing press comprising: a plate cylinder for positioning a printing plate thereon; an ink reservoir for holding a supply of ink; an inking mechanism for transferring the ink between the ink reservoir and the printing plate during operation of the printing press, the inking mechanism comprising a plurality of inking rollers, a plurality of individually adjustable ink zone metering devices disposed in conjunction with the ink reservoir, at least one ink fountain roller positioned adjacent the plurality of individually adjustable ink zone metering devices to receive ink via the metering devices, and at least one ink transfer roller for transferring ink between the ink fountain roller and at least one of the plurality of inking rollers; sheet feeding apparatus for feeding sheets of printing stock into the printing press; a rubber blanket cylinder having a rubber blanket disposed thereabout for receiving an ink impression from the plate cylinder; a sheet drum for receiving sheets being fed for printing the ink impression of the rubber blanket onto the sheets; and dampening apparatus for applying dampening medium to the printing plate. The dampening apparatus comprises: supply apparatus for containing a supply of dampening medium; first roller apparatus for receiving dampening medium from the supply apparatus; second roller apparatus disposed adjacent the first roller apparatus for receiving dampening medium from the first roller apparatus and passing damping medium towards the plate cylinder; apparatus for engaging and disengaging the first roller apparatus and the second roller apparatus; and the apparatus for engaging and disengaging comprising apparatus for automatically disengaging the first roller apparatus and the second roller apparatus. The apparatus for automatically disengaging comprising: apparatus for determining standstill periods; and apparatus for disengaging upon determination of standstill periods; and the apparatus for disengaging being operatively connected to and controlled by the apparatus for determining.

Another aspect of the invention resides broadly in a dampening unit for applying dampening medium to a printing plate, the dampening unit comprising: supply apparatus for containing a supply of dampening medium; first roller apparatus for receiving dampening medium from the supply apparatus; second roller apparatus disposed adjacent the first roller apparatus for receiving dampening medium from the first roller apparatus and passing damping medium towards the plate cylinder; apparatus for engaging and disengaging the first roller apparatus and the second roller apparatus; and the apparatus for engaging and disengaging comprising apparatus for automatically disengaging the first roller apparatus and the second roller apparatus. The apparatus for automatically disengaging comprising: apparatus for determining standstill periods of non-operation of a printing press; and apparatus for disengaging upon determination of standstill periods; and the apparatus for disengaging being operatively connected to and controlled by the apparatus for determining.

A further aspect of the invention resides broadly in a method for operating a printing press, the printing press having periods of time during which the printing press is operating, and periods of time during which the printing press is at a standstill, the printing press comprising: a plate cylinder for positioning a printing plate thereon; an ink reservoir for holding a supply of ink; an inking mechanism for transferring the ink between the ink reservoir and the printing plate during operation of the printing press; sheet feeding apparatus for feeding sheets of printing stock into the printing press; a rubber blanket cylinder having a rubber blanket disposed thereabout for receiving an ink impression from the plate cylinder; a sheet drum for receiving sheets being fed for printing the ink impression of the rubber blanket onto the sheets; and dampening apparatus for applying dampening medium to the printing plate, the dampening apparatus comprising: supply apparatus for containing a supply of dampening medium; first roller apparatus for receiving dampening medium from the supply apparatus; second roller apparatus disposed adjacent the first roller apparatus for receiving dampening medium from the first roller apparatus and passing damping medium towards the plate cylinder; apparatus for engaging and disengaging the first roller apparatus and the second roller apparatus; the apparatus for engaging and disengaging comprising apparatus for automatically disengaging the first roller apparatus and the second roller apparatus; the apparatus for automatically disengaging comprising: apparatus for determining standstill periods; and apparatus for disengaging upon determination of standstill periods; and the apparatus for disengaging being operatively connected to and controlled by the apparatus for determining. The method comprising the steps of: feeding sheets of printing stock to the sheet drum; transferring ink from the ink reservoir to the plate cylinder; operating the dampening apparatus to transfer dampening medium from the dampening medium supply to the plate cylinder; transferring ink from the plate cylinder to the blanket cylinder; transferring ink from the blanket cylinder to sheets of printing stock on the sheet drum; and stopping operation of the printing press by putting the printing press at a standstill. The operating of the dampening apparatus comprising the steps of: during operation of the printing press, engaging the first roller apparatus with the second roller apparatus to transfer dampening medium from the dampening medium supply to the second roller apparatus and pass damping medium from the second roller apparatus towards the plate cylinder; determining a standstill period; and automatically disengaging the first roller apparatus and the second roller apparatus upon determining of a standstill period.

BRIEF DESCRIPTION OF THE DRAWINGS

A specimen embodiment of the invention is schematically illustrated in the accompanying drawings, in which.

DESCRIPTION OF THE PREFERRED EMBODIMENT

Figure 1:
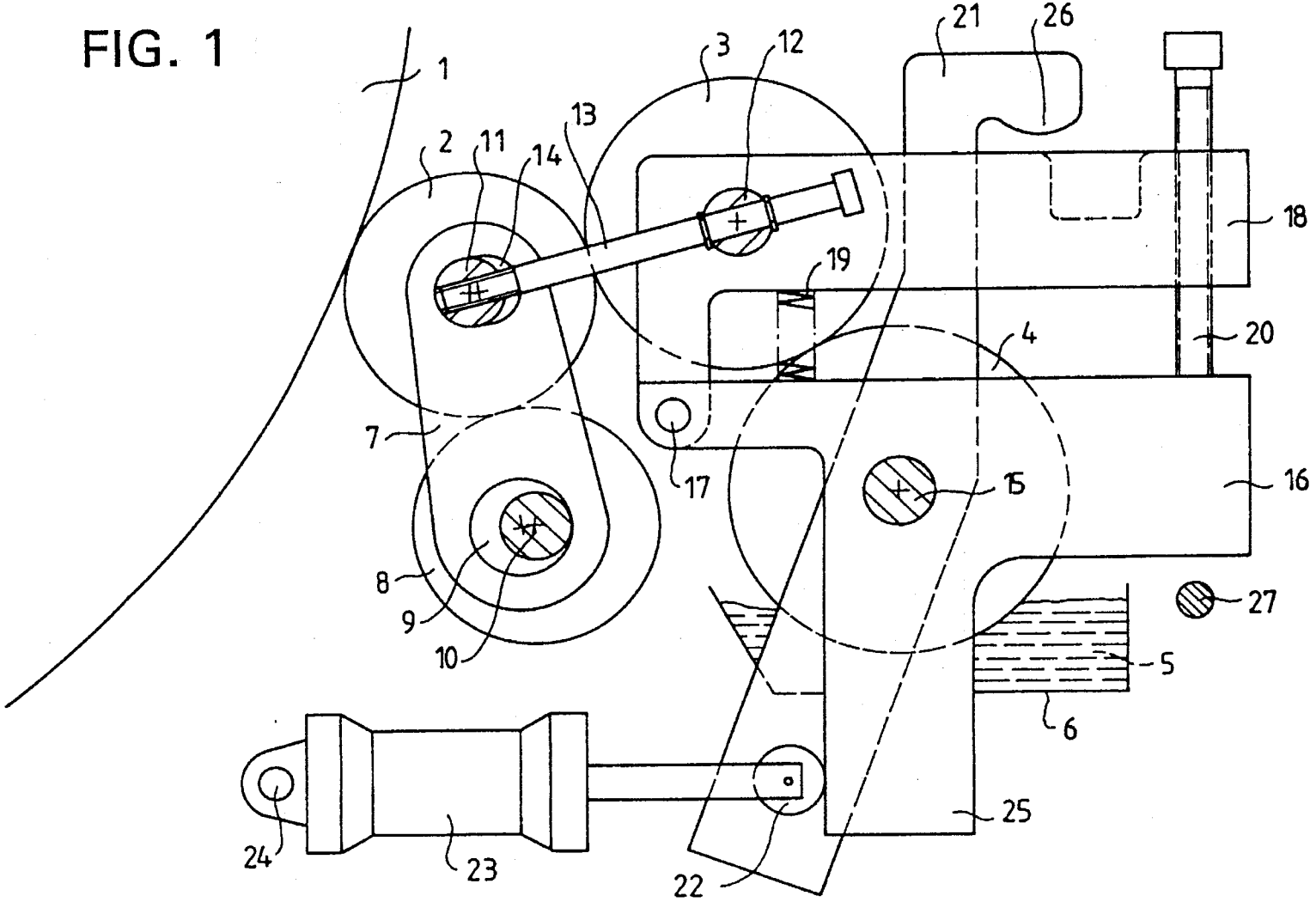
FIG. 1 shows the rollers of the dampening unit in respective engaged positions.
Figure 1A:
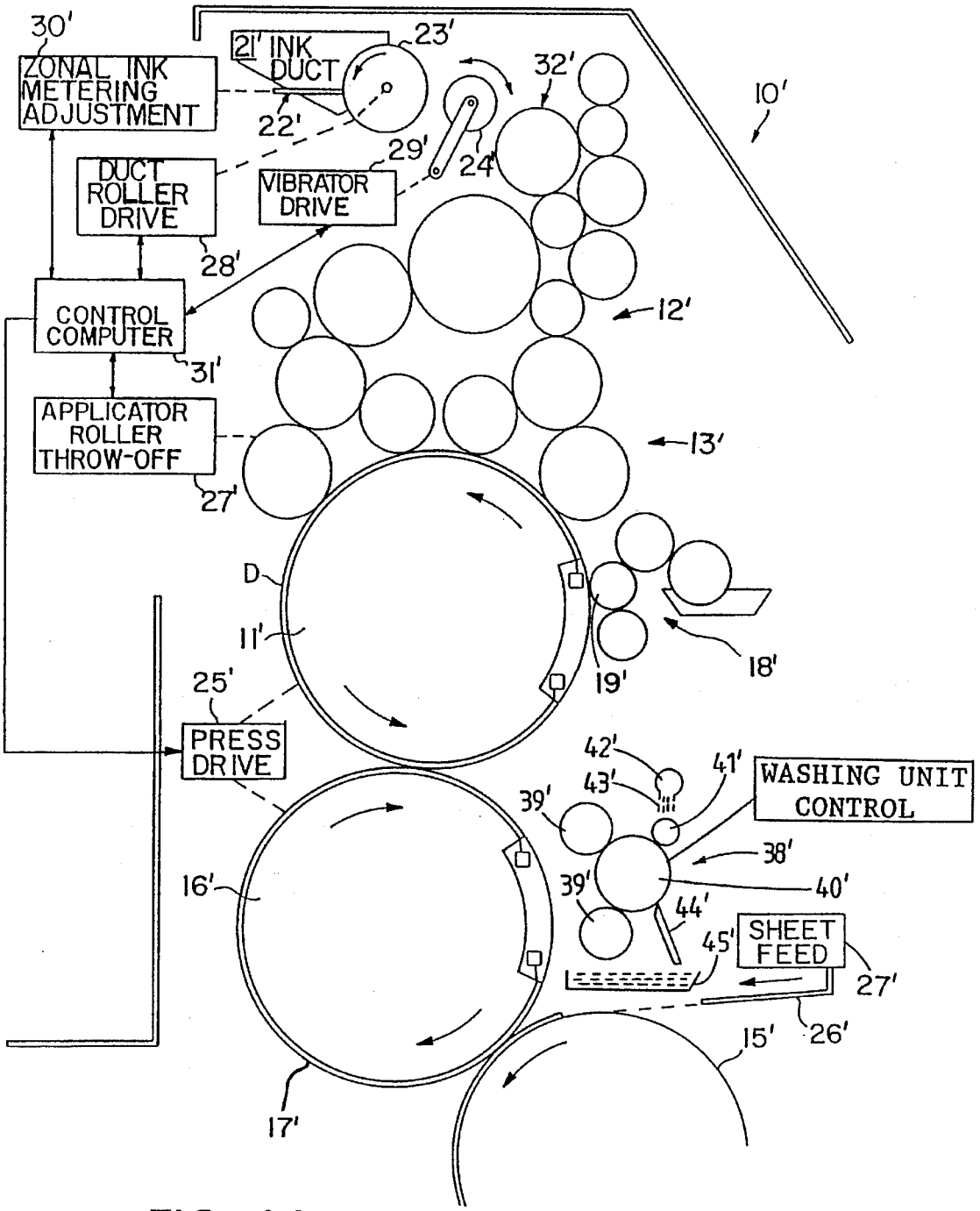
FIG. 1*a* shows an offset printing press.

FIG. 1A shows one type of a printing unit 10' which can be a part of a rotary printing press. In essence, the components depicted thereby, are generally well known in the art, and are therefore only summarized briefly herebelow. While the embodiment depicted by FIG. 1A shows one type of printing press, the apparatus in accordance with the present invention can be applied to other types of presses as well. In the depicted embodiment, the typical parts of a printing unit 10' can generally include: a plate cylinder 11' having mounted thereon a printing plate D; an inking unit 12' which includes ink applicator rollers 13' for applying to printing plate D, an ink profile of a single color printing ink (for example, black, cyan, magenta or yellow, etc.); a dampening (or wetting) unit 18' having dampening applicator rollers 19' for transferring a dampening agent to printing plate D; a blanket cylinder 16' carrying a rubber blanket 17' for receiving an ink impression from printing plate D; and a sheet drum 15' for carrying a printed sheet 14' onto which the ink impression carried by blanket 17' can be transferred.

It is particularly important that the ink be applied to printing plate D in a precisely defined and controllable manner. To this end, the printing unit 10' may be provided with an ink duct 21' which can preferably extend across the width of the inking unit 10'. The zonal adjustment of the ink application profile can be provided by a plurality of ink metering ducts 22', which can preferably be disposed along the length of the ink duct 21', which ducts 22' may be controlled or adjusted by a zonal ink metering adjustment mechanism 30' under the control of a computer 31'.

A duct roller 23' can typically be mounted adjacent to ink duct 21'. Typically, the ink application profile which is set up on duct roller 23' can be transferred into the inking unit 12' by means of a vibrator roller 24' which can oscillate to successively pick up strips of ink from duct roller 23' and transfer them into inking unit 12', as for example, by preferably contacting one of the rollers 32' of the inking unit 12'.

Typically, the printing stand 10' can also include auxiliary mechanisms such as, for example, a duct roller drive 28', a vibrator roller drive 29', an applicator roller throw-off 27' for lifting the ink applicator rollers 13' off of the printing plate D, a press drive 25' and a sheet feed 27' for supplying the sheets to be printed 26' to sheet drive drum 15'.

In addition, the printing press can be provided with at least one washing apparatus for washing the rollers of the press. As shown in the example of FIG. 1A, such a washing apparatus 38' could preferably be configured to cooperate with the blanket cylinder 16', yet it should be understood that other possible placements can be provided within the printing unit. Washing apparatus 38' can preferably be adapted to be brought into contact with the outer cylindrical surface, i.e. with the rubber blanket 17', of rubber blanket cylinder 16', by the operation of a control device, shown schematically, which, in essence could be controlled by the control computer 31'. Washing apparatus 38' can include two washing rollers 39' as well as common roller 40' that connects the two washing rollers 39' together. There could also preferably be a transfer roller 41', which can preferably be in contact with common roller 40' and to which washing liquid 43' can be supplied by either spray apparatus 42', or another similar device. A doctor blade apparatus 44' could be positioned to cooperate with roller 40' to scrape residue from roller 40', and collection trough 45' could be positioned under roller 40' for collecting excess washing liquid and ink residue therein.

Figure 2:
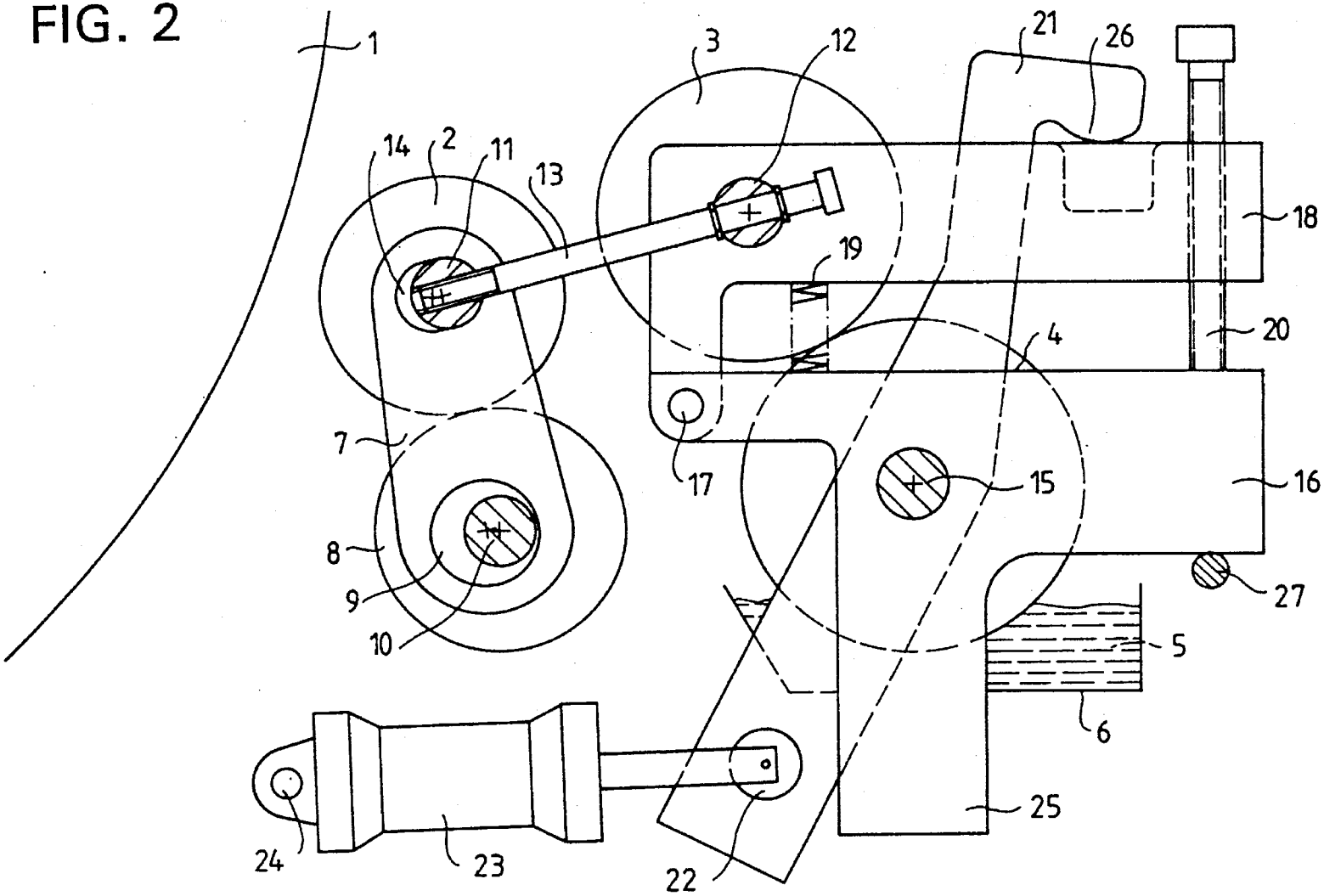
FIG. 2 shows the rollers of the dampening unit in respective disengaged positions.
Figure 2A:
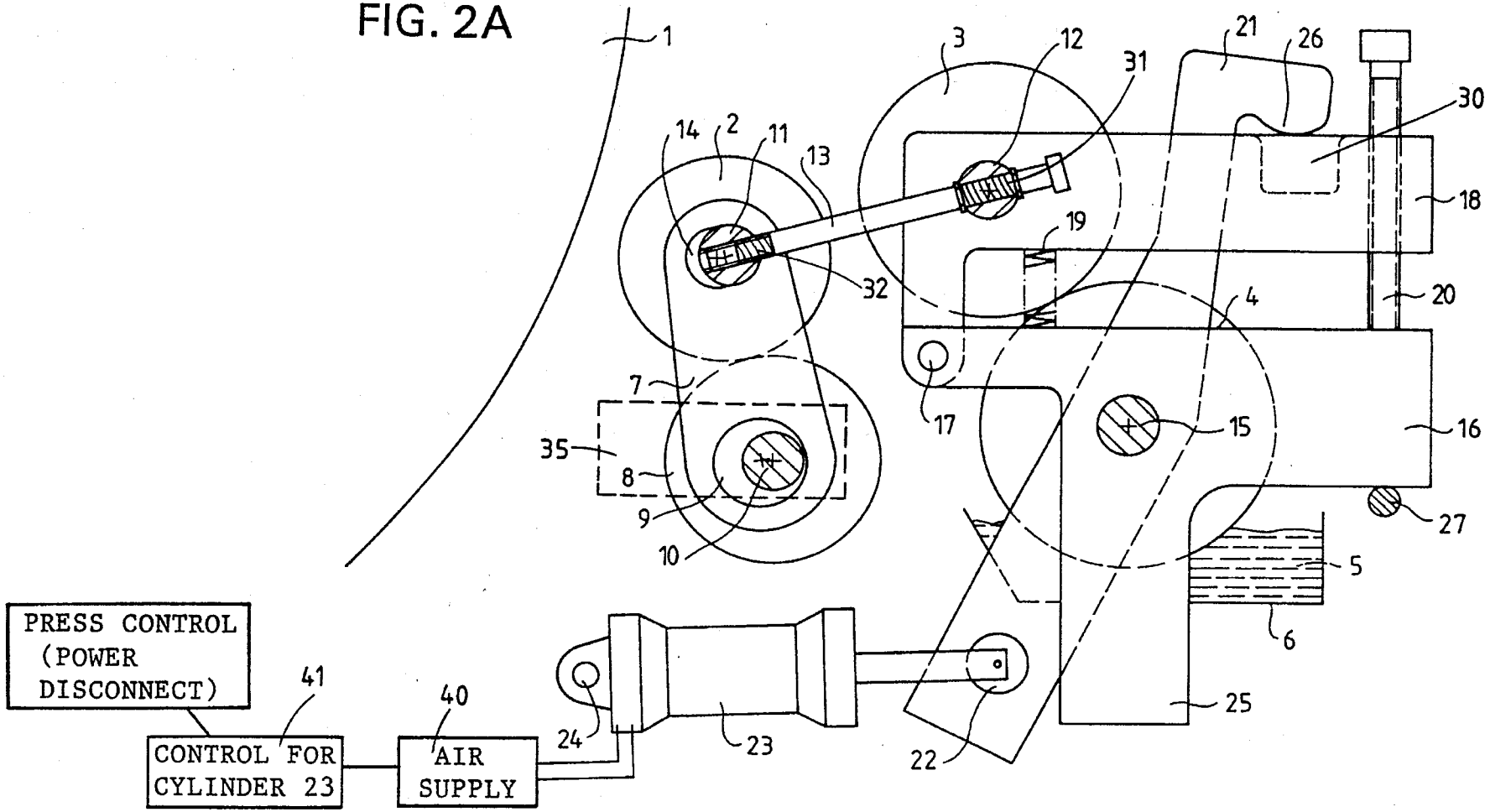
FIG. 2A shows essentially the same arrangement as FIG. 2, but more detailed.

As shown in greater detail in FIG. 1, the dampening unit can be assigned to a plate cylinder 1 and can comprise a forme roller 2 for applying the dampening medium, an intermediate roller 3, and a dipping roller 4 dipping into dampening-medium 5 contained in a dampening-medium tank 6. As illustrated in the specimen embodiment shown, the forme roller 2 can preferably be pivot-mounted on levers 7, which can preferably be provided on both sides of the forme roller 2. Also, an additional distributor roller 8 may also be provided and the distributor roller 8 can preferably be configured to pivot about the forme roller 2. An eccentric bushing 9 on the axle 10 of the distributor roller 8 can preferably be provided to permit the setting of the pressure under which the forme roller 2 is in contact with the distributor roller 8. As depicted in FIG. 2A, an adjustment device 35 could be provided adjacent the bushing 9 for enabling adjustment of the pressure between the forme roller 2 and the distributor roller 8.

Between the axle 11 of the forme roller 2, and the axle 12 of the intermediate roller 3 there can preferably be provided a connecting rod 13, by means of which, when disengaging the intermediate roller 3 from the forme roller 2, the forme roller 2 can be disengaged from the plate cylinder 1. This disengagement of roller 2 from plate cylinder 1 can preferably occur after a certain delay caused by the slit 14 provided in the lever 7, as illustrated in FIGS. 1 and 2.

As shown in FIG. 2A, the disengagement between the rollers 2 and 3 can, in one possible embodiment of the invention, be brought about by means of a spring 31 which can be disposed in a manner to displace the rod 13 away from the roller 3 when the rollers are disengaged from the plate cylinder 1. Preferably, spring 31 can be mounted such that disengagement of rollers 2 and 3 will occur as an immediate consequence of disengaging the roller 2 from the plate cylinder 1. Alternate placement of such a spring, other than as shown in FIG. 2A, is also possible and would be well within the skill of the artisan. Alternatively, the rollers 2 and 3 could be configured in such a manner that roller 2 moves away from roller 3 under the influence of gravity. Further, in order to displace the axle 11, within the slot 14, a further embodiment of the invention could also provide an additional spring element 32, the placement of which would also be within the skill of the artisan, as an alternative to the placement as shown in FIG. 2A.

The axle 15 of the dipping roller 4 can preferably be mounted, on both sides thereof, in the machine side frame. Levers 16 can be pivot-mounted on both sides of the axle 15. By means of pins 17, adjusting levers 18 can preferably be pivot-mounted on the levers 16, the axle 12 of the intermediate roller 3 being, in turn, mounted on the adjusting levers 18. Between lever 16 and adjusting lever 18 there can preferably be provided a biasing, or spring element 19 which may be designed as a compression spring. Furthermore, there can also be provided, between lever 16 and adjusting lever 18, an adjusting screw 20, by means of which adjusting screw 20 it can be possible to set the contact pressure existing between intermediate roller 3 and dipping roller 4 when the rollers 3 and 4 are in either of the respective positions indicated in FIGS. 1 and 2.

Furthermore, an adjusting cam 21 can preferably be mounted on both sides of the axle 15 of the dipping roller 4. A lower area of the adjusting cam 21 can be disposed adjacent an adjustment means 23. The adjustment means 23 can feature a pin 22 attached thereto, and the adjusting means 23 can preferably be a pneumatic cylinder configured for acting on the pin 22. By means of a further pin 24, the adjusting means 23 can preferably be supported on the side frame of the machine. In the position shown in FIG. 1, the adjusting cam 21 can preferably be turned anticlockwise by actuating the adjusting means 23 so that the pin comes into contact with an arm 25 of the lever 16 and pivots the adjusting lever 18 via the adjusting screw 20 so that the intermediate roller 3 is pressed against the forme roller 2 which, in turn, is engaged with the plate cylinder 1. The position shown is the working position of the dampening unit in which the dampening medium is transferred onto the printing plate.

As further depicted in FIG. 2A, the adjustment means 23 can preferably be operated by means of an air source 40 which is connected to a control device 41. Thus, in order to extend the pin 22 away from the adjustment means 23, air can be introduced into the cylinder of the adjustment means. In essence, the adjustment means 23 can be a piston-cylinder arrangement which is commonly known. It is also conceivable that other types of actuating elements, which would be well within the skill of the artisan, could be provided as the adjustment means 23, such as an electric motor, or a hydraulic system, as long as the adjustment device is a "no-force" device when the device is turned off, thereby allowing free movement of the pin 22 when the device is turned off.

With the adjusting means 23 being in the second shift position in which the forme roller 2 is disengaged from the plate cylinder, as shown in FIG. 2, the adjusting cam 21 can be turned clockwise. In so doing, the finger 26 of the adjusting cam 21 can press onto the adjusting lever 18 and, via the adjusting screw 20, onto the lever 16. The lever 16 may thus turn clockwise and come into contact with a stop 27. As a result thereof, the intermediate roller 3 can preferably be lifted off the forme roller 2 and, by means of the connecting rod 13, the forme roller 2 can also be lifted off the plate cylinder 1 after a certain delay caused by the slit 14. This position indicated in FIG. 2 can preferably be used to interrupt the dampening, e.g. in the case of machine standstills, that is, for momentary, or short periods of time, wherein the printing press will be operated shortly thereafter.

In one embodiment of the present invention, as shown in FIG. 2A, the adjusting lever 18 could preferably have a lateral projection 30 extending therefrom. This lateral projection 30 can thereby preferably provide an enlarged surface which can be engaged by the finger 26 of the cam 21. Alternatively, in another embodiment, this projection 30 could comprise a bar which extends across the width of the printing stand to the adjusting lever 18 at the opposite side of the printing stand. A still further embodiment of the invention, wherein the adjusting cam 21 is disposed laterally inward of the adjusting lever 18, could have the top finger 26 of the cam 21 bent laterally outward over the adjusting lever 18 to thereby provide a means for contact between the finger 26 and the lever 18.

Figure 3:
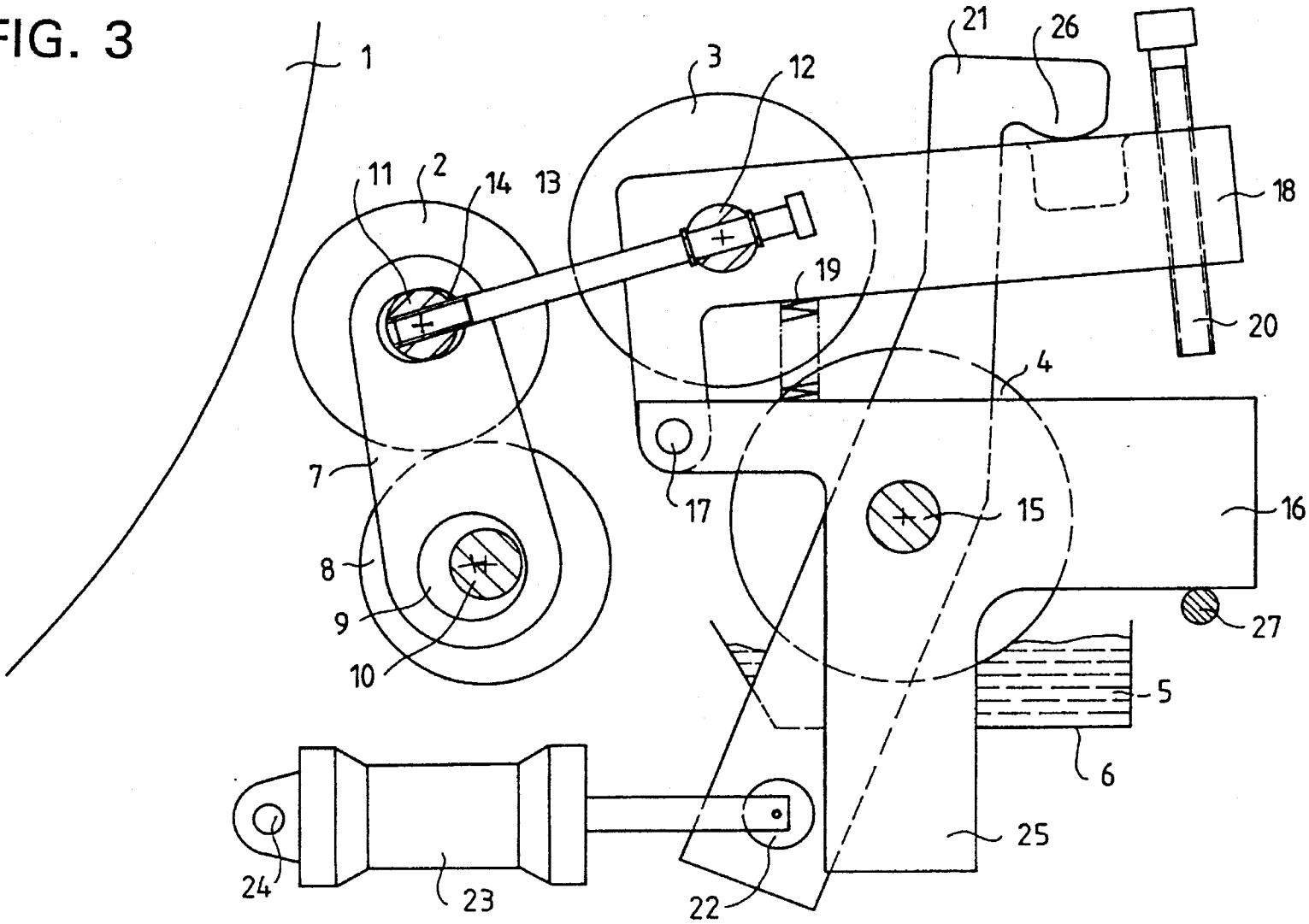
FIG. 3 shows the rollers of the dampening unit in respective disengaged positions while the machine is out of operation, wherein the adjusting means is not subjected to a force-storing means.

The positions of the individual rollers depicted in FIG. 3 show the machine out of operation, or with power disconnected from the adjustment means 23, so that the adjusting means 23 can be free of force. As depicted in FIG. 2A, such a power disconnect could be part of the main control of the printing press, and could preferably and could preferably cut power to the control mechanism which operates the air supply, thereby enabling the pin 22 to move freely with respect to the adjustment means 23. In this situation, because essentially no resistance would be provided by adjustment means 23, the biasing force provided by the spring element 19 would essentially cause the adjusting lever 18 to pivot away from the lever 16 so that the intermediate roller 3 can be disengaged from the dipping roller 4. This disengagement between rollers 3 and 4 can thereby prevent the intermediate roller 3 from leaving any permanent deformation on the outer cylindrical surface of the dipping roller 4 when the machine is out of operation for an extended period of time, i.e. over a weekend.

Figure 4:
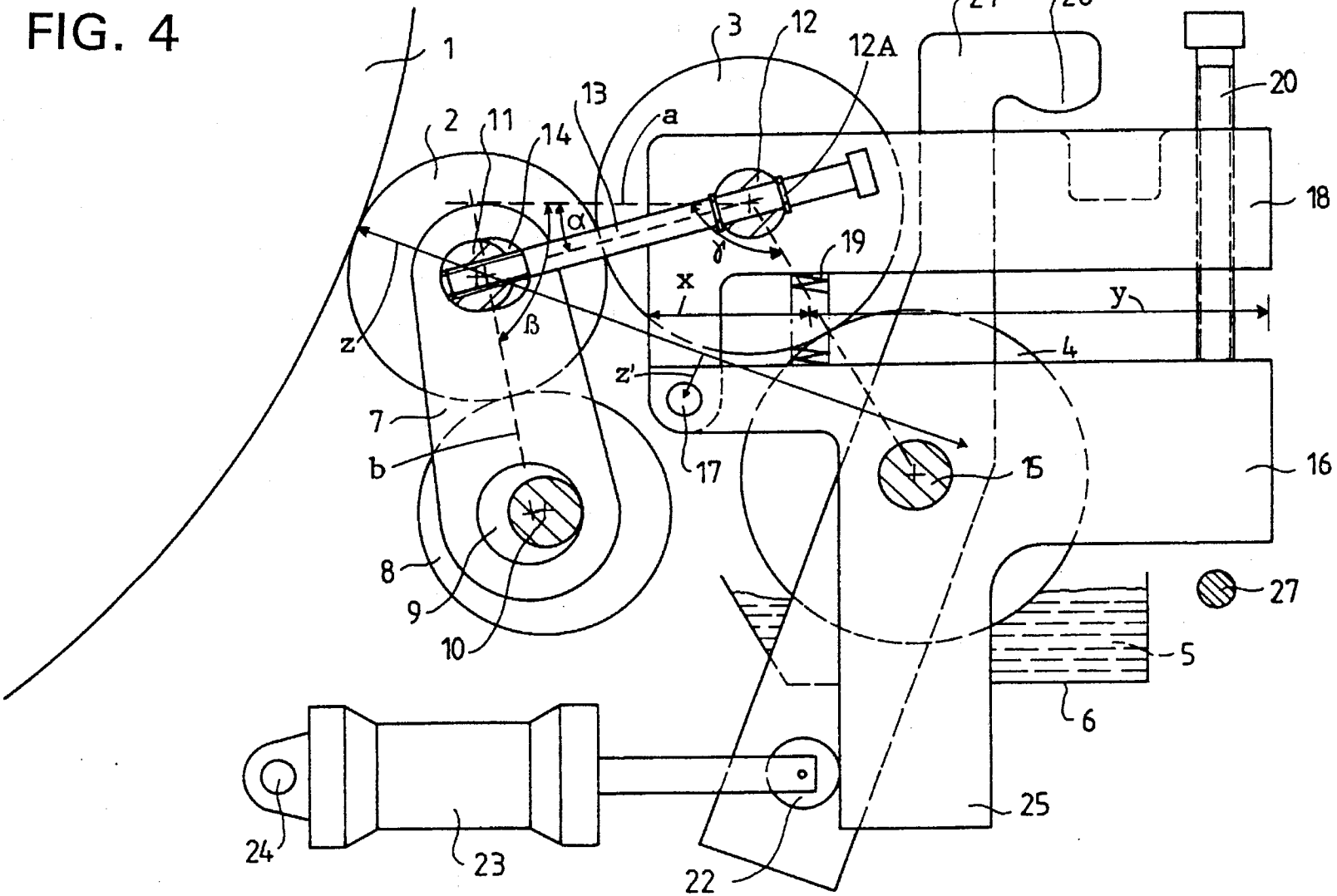
FIG. 4 shows the same arrangement as FIG. 1, but more detailed.

As depicted in FIG. 4, one possible embodiment of the invention might have the biasing, or spring element 19 disposed such that the relationship of the distance (x) to the distance (y) is about 1:3. In one possible embodiment, the contact pressure between the plate cylinder 1 and the forme roller 2 could produce a force as generally represented as (z). With respect to the hinge pins 17, this force (z) could have a lever arm of (z'). Thus, the pressure force (z) would tend to rotate the adjusting lever 18 in a clockwise direction about pin 17. Such a rotation, would, in essence, compress the biasing member 19 to store a force that could then open the lever 18 in the absence of any resistance arrangement, as depicted in FIG. 3. Further, the mounting 12A for attaching the connecting rod 13 with respect to the axle 12 could preferably be fixed in a non-rotating manner. Thus, when the contact force is applied in the direction (z), the lever 18 would close and put the roller 3 into contact with the dipping roller 4, against the force of biasing, or spring element 19.

The positioning of the biasing, or spring element 19, with regard to distances (x) and (y), along with the compression force of the biasing member 19 can essentially be understood to be factors of the configuration and placement of the rollers 2, 3 and 4 with respect to one antoher, and the pivots 17, 15, etc. about which the roller move. It is submitted that one would be able to readily determine the size, spring force, and placement of biasing member 19 without undue experimentation, if variation of size and placement were necessary for different space configurations, etc.

As depicted by FIG. 4, the positioning of the rollers with respect to one another and a plane defined by (a), in one possible embodiment of the invention could possibly be as described below. In this regard, the plane (a) could possibly be a horizontal plane, however plane (a) could also be angled with respect to horizontal. In essence, the center of rotation of axle 12 of the intermediate roller 3 could be disposed in the plane (a). Then, the center of rotation of axle 15 of dipping roller 4 could possibly be disposed at an angle (gamma) of about 120 degrees with respect to the plane (a) and the center of rotation of axle 12. Similarly, the center of rotation of axle 11 of forme roller 2 could possibly be disposed at an angle (alpha) of about 15 degrees with respect to the plane (a) and the center of of rotation of axle 12. The lever 7 can define a longitudinal axis (b), and this longitudinal axis (b) could possibly be disposed at an angle (beta) of about 100 degrees with respect to the plane (a).

In alternative possible embodiments of the present invention, which would provide variations on the angles (alpha), (beta) and (gamma) as described immediately hereabove, the angles (alpha), (beta) and (gamma) could vary by plus/minus 1 degree, 2 degrees, 3 degrees, 4 degrees, 5 degrees, 6 degrees, 7 degrees, 8 degrees, 9 degrees or 10 degrees, or even more.

One feature of the invention resides broadly in the dampening unit for an offset printing machine for feeding dampening medium to a printing plate of a plate cylinder, said dampening unit comprising at least one forme roller engageable with the plate cylinder, at least one intermediate roller between the forme roller and a dipping roller dipping into dampening medium contained in a dampening-medium tank, and adjusting means through which the forme roller is engageable with the plate cylinder and the intermediate roller with the forme roller and the dipping roller, said forme roller being pivot-mounted, and connecting means being provided between forme roller and intermediate roller, characterized in that, through a force-storing means 19, the intermediate roller 3 is mounted so as to be automatically disengageable form the dipping roller 4 when the printing machine is at a standstill.

Another feature of the invention resides broadly in the dampening unit characterized in that, on both sides of the dipping roller 4, there are provided levers 16 which are pivot-mounted about the center of said dipping roller, that adjusting levers 18 in which the intermediate roller 3 is mounted are pivot-mounted on said levers, that the levers 16 and the adjusting levers 18 are supported with respect to each other via a spring element 19, that adjusting cams 21 which are pivot-mounted about the center of the dipping roller are provided on both sides of said dipping roller 4, adjusting means 23 acting on said adjusting cams 21, said adjusting means, when being in a shift position in which the forme roller 2 is engaged, turning the lever anticlockwise so that also the adjusting lever 18 may be turned, e.g., via an adjusting screw 20, and that all rollers are in engagement with each other, that, when being in a second shift position in which the forme roller 2 is disengaged, the adjusting cam 21 turns the adjusting lever 18 and, via the adjusting screw 20, the lever 16 clockwise so that the forme roller 2 is disengaged from the plate cylinder 1 and the intermediate roller 3 from the forme roller 2, and that, given a force-free adjusting means 23, the spring element 19 pivots the adjusting lever 18 away from the lever 16 so that the intermediate roller 3 is disengaged from the dipping roller 4.

Yet another feature of the invention resides broadly in the dampening unit characterized in that, seen clockwise, the lever 16 is into contact with a stop 27, with the dampening unit being in a disengaged position.

Some additional examples of dampening units and parts thereof, which could possibly be used in the context of the present invention are disclosed by the following U.S. Pat. Nos.: 4,872,406 to Hans-Jürgen Kusch, entitled "Dampening Mechanism for Offset Rotary Printing Presses; 4,922,818 to Rudi Junghans, entitled "Wetting/Inking Mechanism for Offset Printing Presses"; and 5,086,696 to Rudi Junghans, entitled "Wetting/Inking Mechanism for Offset Printing Presses".

The appended drawings in their entirety, including all dimensions, proportions and/or shapes in at least one embodiment of the invention, are accurate and to scale and are hereby included by reference into this specification. In this regard, the proportions as depicted in the drawings, with regard to size and placement, etc. should be understood as depicting a single embodiment of the present invention, while sizes, and positioning, etc, could be proportionally varied for the parts while staying within the scope of the present invention.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 12 523.9, filed on Apr. 16, 1993, having inventors Peter Heiler and Jürgen Rautert, and DE-OS P 43 12 523.9 and DE-PS P 43 12 523.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit scope of the invention.

What is claimed is:

1. A printing press for printing images on sheets of printing stock, the printing press having periods of time during which the printing press is operating, and periods of time during which the printing press is at a standstill, said printing press comprising:

a plate cylinder for positioning a printing plate thereon;

an ink reservoir for holding a supply of ink;

an inking mechanism for transferring the ink between the ink reservoir and the printing plate during operation of the printing press, said inking mechanism comprising a plurality of inking rollers, a plurality of individually adjustable ink zone metering devices disposed in conjunction with the ink reservoir, at least one ink fountain roller positioned adjacent said plurality of individually adjustable ink zone metering devices to receive ink via said metering devices, and at least one ink transfer roller for transferring ink between said ink fountain roller and at least one of said plurality of inking rollers;

sheet feeding means for feeding sheets of printing stock into the printing press;

a rubber blanket cylinder having a rubber blanket disposed thereabout for receiving an ink impression from the plate cylinder;

a sheet drum for receiving sheets being fed for printing the ink impression of the rubber blanket onto the sheets; and dampening means for applying dampening medium to said printing plate, said dampening means comprising:

supply means for containing a supply of dampening medium;

first roller means for receiving dampening medium from said supply means;

second roller means disposed adjacent said first roller means for receiving dampening medium from said first roller means and passing damping medium towards said plate cylinder;

means for engaging and disengaging said first roller means and said second roller means;

said means for engaging and disengaging comprising means for automatically disengaging said first roller means and said second roller means;

said means for automatically disengaging comprising:

means for determining standstill periods; and means for disengaging upon determination of standstill periods, said means for disengaging comprising means for biasing said second roller means away from said first roller means during standstill periods to disengage said first roller means and said second roller means during standstill periods; and said means for disengaging being operatively connected to and controlled by said means for determining.

2. The printing press according to claim 1, wherein:

said printing press further comprises control means for controlling operation of said printing press;

said control means comprises means for operating said means for engaging and disengaging, and for interrupting operation of said means for engaging and disengaging for standstill periods;

said means for engaging and disengaging, during standstill periods, being configured to be freely movable; and said biasing means moves said second roller means away from said first roller means to disengage said first roller means and said second roller means during standstill periods.

3. The printing press according to claim 2, wherein:

said dampening means further comprises first lever means mounted to pivot with respect to said first roller means;

said second roller means being mounted on said first lever means to pivot with said first lever means;

said biasing means being disposed to pivot said first lever means away from said first roller means to disengage said second roller means from said first roller means; and said means for engaging and disengaging further comprises:

cam means for moving said first lever means towards said first roller means to engage said second roller means with said first roller means; and means for moving said cam means to engage said cam means with said first lever means to move said first lever means towards said first roller means and to disengage said cam means from said first lever means.

4. The printing press according to claim 3, wherein:

said first roller means has a first axis about which said first roller means rotates;

said dampening means further comprises second lever means pivotable about said first roller axis, said second lever means has a first portion disposed towards said plate cylinder, at a position between said first roller means and said plate cylinder, and a second portion disposed away from said plate cylinder on an opposite side of said first roller means;

said first lever means has a first end and a second end, said first end of said first lever means is pivot mounted to said second lever means at said first portion of said second lever means, and said second end of said first lever means is disposed adjacent said second portion of said second lever means; and said biasing means is disposed between said first and second lever means at a distance from said pivot mounting between said first and second lever means towards said second portion of said second lever means.

5. The printing press according to claim 4, wherein:

said dampening means further comprises at least one third roller means disposed between said second roller means and said plate cylinder to receive damping medium from said second roller means and transfer damping medium to said plate cylinder;

said cam means is pivotably mounted about said first roller axis;

said cam means has a first end for engaging said first lever means and a second end connected to said means for moving said cam means;

said second end of said first lever means comprises means for contacting said second portion of said second lever means, said means for contacting comprising adjustment means for adjusting a spacing between said second end of said first lever and said second portion of said second lever means to adjust a contact pressure between said first roller means and said second roller means;

said second lever means comprises a third lever portion disposed in a direction away from said first lever means, said third lever portion being disposed adjacent said second end of said cam means;

said means for moving said cam means further comprises means for engaging said third portion of said second lever means to rotate said second lever means about said first roller axis;

said means for moving is configured for rotating said third portion of said second lever means in a direction away from said plate cylinder to rotate said first portion of said second lever means towards said plate cylinder to move said second roller means into engagement with both of said first roller means and said third roller means, and to move said third roller means into engagement with said plate cylinder; and said means for moving is configured for pivoting said second end of said cam means towards said plate cylinder to engage said first end of said cam means with said second end of said first lever means to engage said means for contacting of said second end of said first lever means with said second portion of said second lever means to rotate said first portion of said second lever means away from said plate cylinder and disengage said third roller means from said plate cylinder and disengage said third roller means from said second roller means.

6. The printing press according to claim 5, wherein:

said dampening means further comprises stop means for limiting rotation of said second lever means about said first roller axis during rotation of said first portion of said second lever means away from said plate cylinder;

said first lever means comprises mounting means for mounting said third roller means to said first lever means;

said mounting means comprising a first portion disposed in a non-pivoting manner at said first end of said first lever means and a connecting rod portion slidably disposed through said first portion; and said connecting rod portion having a first end slidably disposed within said first portion of said mounting means and a second end opposite thereto, said third roller means being mounted to said second end of said connecting rod portion for movement of said third roller means towards and away from said second roller means.

7. The printing press according to claim 6, wherein:

said dampening means further comprises fourth roller means in engagement with said third roller means;

said dampening means further comprises a mounting plate for mounting said fourth roller means to said third roller means;

said mounting plate comprising an eccentric bearing for mounting said fourth roller means thereto, said eccentric bearing being configured for varying contact pressure between said third and fourth roller means;

said adjustment means for adjusting the spacing between said second end of said first lever means and said second portion of said second lever means comprises screw means threadably disposed through said second end of said first lever means, said screw means comprising said portion for contacting said second portion of said second lever means; and said means for moving comprises a pneumatic cylinder having a piston rod extending therefrom, said piston rod having a first end fixedly connected to said second end of said cam means, and said first end of said piston rod comprises pin means for engaging said third portion of said second lever means.

8. A dampening unit for applying dampening medium to a printing plate in a printing press, the dampening unit comprising:

a plate cylinder for positioning a printing plate thereon;

supply means for containing a supply of dampening medium;

first roller means for receiving dampening medium from said supply means;

second roller means disposed adjacent said first roller means for receiving dampening medium from said first roller means and passing damping medium towards the plate cylinder;

means for engaging and disengaging said first roller means and said second roller means;

said means for engaging and disengaging comprising means for automatically disengaging said first roller means and said second roller means;

said means for automatically disengaging comprising:

means for determining standstill periods of non-operation of a printing press; and means for disengaging upon determination of standstill periods, said means for disengaging comprises means for biasing said second roller means away from said first roller means during standstill periods to disengage said first roller means and said second roller means during standstill periods; and said means for disengaging being operatively connected to and controlled by said means for determining.

9. The dampening unit according to claim 8, wherein:

said dampening unit further comprises control means for controlling operation of said means for engaging and disengaging for operating said means for engaging and disengaging, and for interrupting operation of said means for engaging and disengaging for standstill periods;

said means for engaging and disengaging, during standstill periods, being configured to be freely movable; and said biasing means moves said second roller means away from said first roller means to disengage said first roller means and said second roller means during standstill periods.

10. The dampening unit according to claim 9, wherein:

said dampening unit further comprises first lever means mounted to pivot with respect to said first roller means;

said second roller means being mounted on said first lever means to pivot with said first lever means;

said biasing means being disposed to pivot said first lever means away from said first roller means to disengage said second roller means from said first roller means; and said means for engaging and disengaging further comprises:

cam means for moving said first lever means towards said first roller means to engage said second roller means with said first roller means; and means for moving said cam means to engage said cam means with said first lever means to move said first lever means towards said first roller means and to disengage said cam means from said first lever means.

11. The dampening unit according to claim 10, wherein:

said first roller means has a first axis about which said first roller means rotates;

said dampening unit further comprises second lever means pivotable about said first roller axis, said second lever means has a first portion disposed towards said plate cylinder, at a position between said first roller means and said plate cylinder, and a second portion disposed away from said plate cylinder on an opposite side of said first roller means;

said first lever means has a first end and a second end, said first end of said first lever means is pivot mounted to said second lever means at said first portion of said second lever means, and said second end of said first lever means is disposed adjacent said second portion of said second lever means; and said biasing means is disposed between said first and second lever means at a distance from said pivot mounting between said first and second lever means towards said second portion of said second lever means.

12. The dampening unit according to claim 11, wherein:

said dampening unit further comprises at least one third roller means disposed between said second roller means and said plate cylinder to receive damping medium from said second roller means and transfer damping medium to said plate cylinder;

said cam means is pivotably mounted about said first roller axis;

said cam means has a first end for engaging said first lever means and a second end connected to said means for moving said cam means;

said second end of said first lever means comprises means for contacting said second portion of said second lever means, said means for contacting comprising adjustment means for adjusting a spacing between said second end of said first lever and said second portion of said second lever means to adjust a contact pressure between said first roller means and said second roller means;

said second lever means comprises a third lever portion disposed in a direction away from said first lever means, said third lever portion being disposed adjacent said second end of said cam means;

said means for moving said cam means further comprises means for engaging said third portion of said second lever means to rotate said second lever means about said first roller axis;

said means for moving is configured for rotating said third portion of said second lever means in a direction away from said plate cylinder to rotate said first portion of said second lever means towards said plate cylinder to move said second roller means into engagement with both of said first roller means and said third roller means, and to move said third roller means into engagement with said plate cylinder; and said means for moving is configured for pivoting said second end of said cam means towards said plate cylinder to engage said first end of said cam means with said second end of said first lever means to engage said means for contacting of said second end of said first lever means with said second portion of said second lever means to rotate said first portion of said second lever means away from said plate cylinder and disengage said third roller means from said plate cylinder and disengage said third roller means from said second roller means.

13. The dampening unit according to claim 12, wherein:

said dampening unit further comprises stop means for limiting rotation of said second lever means about said first roller axis during rotation of said first portion of said second lever means away from said plate cylinder;

said first lever means comprises mounting means for mounting said third roller means to said first lever means;

said mounting means comprising a first portion disposed in a non-pivoting manner at said first end of said first lever means and a connecting rod portion slidably disposed through said first portion; and said connecting rod portion having a first end slidably disposed within said first portion of said mounting means and a second end opposite thereto, said third roller means being mounted to said second end of said connecting rod portion for movement of said third roller means towards and away from said second roller means.

14. The dampening unit according to claim 13, wherein:

said dampening unit further comprises fourth roller means in engagement with said third roller means;

said dampening unit further comprises a mounting plate for mounting said fourth roller means to said third roller means;

said mounting plate comprising an eccentric bearing for mounting said fourth roller means thereto, said eccentric bearing being configured for varying contact pressure between said third and fourth roller means;

said adjustment means for adjusting the spacing between said second end of said first lever means and said second portion of said second lever means comprises screw means threadably disposed through said second end of said first lever means, said screw means comprising said portion for contacting said second portion of said second lever means; and said means for moving comprises a pneumatic cylinder having a piston rod extending therefrom, said piston rod having a first end fixedly connected to said second end of said cam means, and said first end of said piston rod comprises pin means for engaging said third portion of said second lever means.

15. A method for operating a printing press, the printing press having periods of time during which the printing press is operating, and periods of time during which the printing press is at a standstill, the printing press comprising: a plate cylinder for positioning a printing plate thereon; an ink reservoir for holding a supply of ink; an inking mechanism for transferring the ink between the ink reservoir and the printing plate during operation of the printing press; sheet feeding means for feeding sheets of printing stock into the printing press; a rubber blanket cylinder having a rubber blanket disposed thereabout for receiving an ink impression from the plate cylinder; a sheet drum for receiving sheets being fed for printing the ink impression of the rubber blanket onto the sheets; and dampening means for applying dampening medium to said printing plate, said dampening means comprising: supply means for containing a supply of dampening medium; first roller means for receiving dampening medium from said supply means; second roller means disposed adjacent said first roller means for receiving dampening medium from said first roller means and passing damping medium towards said plate cylinder; means for engaging and disengaging said first roller means and said second roller means; said means for engaging and disengaging comprising means for automatically disengaging said first roller means and said second roller means; said means for automatically disengaging comprising: means for determining standstill periods; and means for disengaging upon determination of standstill periods, said means for disengaging comprising means for biasing said second roller means away from said first roller means during standstill periods to disengage said first roller means and said second roller means during standstill periods; and said means for disengaging being operatively connected to and controlled by said means for determining, said method comprising the steps of:

feeding sheets of printing stock to the sheet drum;

transferring ink from the ink reservoir to the plate cylinder;

operating said dampening means to transfer dampening medium from the dampening medium supply to the plate cylinder;

transferring ink from the plate cylinder to the blanket cylinder;

transferring ink from the blanket cylinder to sheets of printing stock on the sheet drum; and stopping operation of the printing press by putting the printing press at a standstill;

said operating of said dampening means comprising the steps of:

during operation of the printing press, engaging said first roller means with said second roller means to transfer dampening medium from the dampening medium supply to the second roller means and pass damping medium from said second roller means towards the plate cylinder;

determining a standstill period; and biasing said second roller means away from said first roller means during standstill periods to automatically disengage said first roller means and said second roller means during a standstill period.

16. The method according to claim 15, wherein the printing press further comprises control means for controlling operation of the printing press, the control means comprises means for operating the means for engaging and disengaging, and for interrupting operation of the means for engaging and disengaging for standstill periods; the means for engaging and disengaging, during standstill periods, being configured to be freely movable; and said method further comprises the step of:

interrupting operation of the means for engaging and disengaging to make the means for engaging and disengaging freely movable during standstill periods.

17. The method according to claim 16, wherein the dampening means further comprises first lever means mounted to pivot with respect to the first roller means; the second roller means is mounted on the first lever means to pivot with the first lever means; the biasing means is disposed to pivot the first lever means away from said first roller means to disengage the second roller means from the first roller means; and the means for engaging and disengaging further comprises: cam means for moving the first lever means towards the first roller means to engage the second roller means with the first roller means; and means for moving the cam means to engage the cam means with the first lever means to move the first lever means towards the first roller means and to disengage the cam means from the first lever means, and said method further comprises:

during operation of the printing press:

moving the cam means with the means for moving to engage said cam means with the first lever means, and to move the first lever means towards the first roller means to engage the second roller means with the first roller means; and moving the cam means with the means for moving to disengage said cam means from the first lever means; and during standstill periods, with the cam means disengaged from the first lever means, permitting movement of the first lever means away from the first roller means to disengage the second roller means from the first roller means.

18. The method according to claim 17, wherein the first roller means has a first axis about which the first roller means rotates; the dampening means further comprises second lever means pivotable about the first roller axis, the second lever means has a first portion disposed towards the plate cylinder, at a position between the first roller means and the plate cylinder, and a second portion disposed away from the plate cylinder on an opposite side of the first roller means; the first lever means has a first end and a second end, the first end of the first lever means is pivot mounted to the second lever means at the first portion of the second lever means, and the second end of the first lever means is disposed adjacent the second portion of said second lever means; and said method further comprises the step of:

pivoting the first lever means, at the first end thereof, on the second lever means to move the second end of the first lever means towards and away from the second portion of the second lever means to engage and disengage the first roller means and the second roller means.

19. The method according to claim 18, wherein the dampening means further comprises at least one third roller means disposed between the second roller means and the plate cylinder to receive damping medium from the second roller means and transfer damping medium to the plate cylinder during operation of the printing press; the cam means is pivotably mounted about the first roller axis; the cam means has a first end for engaging the first lever means and a second end connected to the means for moving the cam means; the second end of the first lever means comprises means for contacting the second portion of the second lever means, the means for contacting comprising adjustment means for adjusting a spacing between the second end of the first lever and the second portion of the second lever means to adjust a contact pressure between the first roller means and the second roller means; the second lever means comprises a third lever portion disposed in a direction away from the first lever means, the third lever portion being disposed adjacent the second end of the cam means; and the means for moving the cam means further comprises means for engaging the third portion of the second lever means to rotate the second lever means about the first roller axis; and said method further comprises:

during operation of the printing press, rotating the third portion of the second lever means in a direction away from the plate cylinder to rotate the first portion of the second lever means towards the plate cylinder to move the second roller means into engagement with both of the first roller means and the third roller means, and to move the third roller means into engagement with the plate cylinder;

pivoting the second end of the cam means towards the plate cylinder to engage the first end of the cam means with the second end of the first lever means to engage the means for contacting of the second end of the first lever means with the second portion of the second lever means to rotate the first portion of the second lever means away from the plate cylinder and disengage the third roller means from the plate cylinder and disengage the third roller means from the second roller means; and interrupting power to said means for engaging and disengaging during standstill periods and disengaging said first roller means from said second roller means by permitting movement of said first lever means away from said second lever means.

20. The method according to claim 19, wherein the dampening means further comprises stop means for limiting rotation of the second lever means about the first roller axis during rotation of the first portion of the second lever means away from the plate cylinder; the first lever means comprises mounting means for mounting the third roller means to the first lever means; the mounting means comprises a first portion disposed in a non-pivoting manner at the first end of the first lever means and a connecting rod portion slidably disposed through the first portion; and the connecting rod portion having a first end slidably disposed within the first portion of the mounting means and a second end opposite thereto, the third roller means being mounted to the second end of the connecting rod portion for movement of the third roller means towards and away from the second roller means; and said method further comprises the steps of:

sliding the connecting rod portion through the first portion of the mounting means in a direction towards the second end of the first lever means to engage the third roller means with the second roller means;

sliding the connecting rod portion through the first portion of the mounting means in a direction away from the second end of the first lever means to disengage the third roller means from the second roller means; and rotating the second lever means in a direction moving the first end of the second lever means away from the plate cylinder until the second portion of the second lever means contacts the stop means.

* * * * *

UNITED STATES PATENT AND TRADEMARK OFFICE

CERTIFICATE OF CORRECTION

PATENT NO. : 5,460,088

DATED : October 24, 1995

INVENTOR(S) : Peter HEILER and Jürgen RAUTERT

It is certified that error appears in the above-indentified patent and that said Letters Patent is hereby corrected as shown below:

On the title page, item [57], in the Abstract section, line 7 of the Abstract, after 'one' delete "form" and insert --forme--.

On the title page, item [57], in the Abstract section, line 10 of the Abstract, after 'the' delete "form" and insert --forme--.

On the title page, item [57], in the Abstract section, line 11 of the Abstract, after 'the' delete "form" and insert --forme--.

On the title page, item [57], in the Abstract section, line 13 of the Abstract, before the first occurrence of 'roller' delete "form" and insert --forme--.

In column 7, line 66, after 'one' delete "antoher" and insert --another,--.

Signed and Sealed this

Twentieth Day of August, 1996

*Attest:*

*Attesting Officer*

BRUCE LEHMAN

*Commissioner of Patents and Trademarks*